US010450679B2

(12) United States Patent
Matsumoto et al.

(10) Patent No.: US 10,450,679 B2
(45) Date of Patent: Oct. 22, 2019

(54) FLAME-RETARDANT FABRIC, METHOD FOR PRODUCING SAME AND FIREPROTECTIVE CLOTHES COMPRISING SAME

(71) Applicant: KANEKA CORPORATION, Osaka-shi, Osaka (JP)

(72) Inventors: Yoshitomo Matsumoto, Takasago (JP); Tatsuro Ohzeki, Takasago (JP); Fukashi Shibuya, Takasago (JP); Kazuya Kusunoki, Takasago (JP)

(73) Assignee: KANEKA CORPORATION, Osaka-Shi, Osaka (JP)

( * ) Notice: Subject to any disclaimer, the term of this patent is extended or adjusted under 35 U.S.C. 154(b) by 658 days.

(21) Appl. No.: 14/913,520

(22) PCT Filed: Aug. 22, 2014

(86) PCT No.: PCT/JP2014/071975
§ 371 (c)(1),
(2) Date: Feb. 22, 2016

(87) PCT Pub. No.: WO2015/025948
PCT Pub. Date: Feb. 26, 2015

(65) Prior Publication Data

US 2016/0201236 A1 Jul. 14, 2016

(30) Foreign Application Priority Data

Aug. 23, 2013 (JP) ..... 2013-172976

(51) Int. Cl.
*D04B 1/24* (2006.01)
*D04B 1/16* (2006.01)
(Continued)

(52) U.S. Cl.
CPC ..... *D04B 1/24* (2013.01); *A41D 31/08* (2019.02); *A62B 17/003* (2013.01); *D01F 1/07* (2013.01);
(Continued)

(58) Field of Classification Search
CPC ... D04B 1/24; A41D 31/0022; D06M 13/282; D06M 13/447; D06M 11/47;
(Continued)

(56) References Cited

U.S. PATENT DOCUMENTS 5,378,243 A 1/1995 Lei et al.
6,491,727 B1 * 12/2002 Rearick ..... D06M 13/352 8/116.1
(Continued)

FOREIGN PATENT DOCUMENTS

CN 1090612 A 8/1994
CN 1285014 A 2/2001
(Continued)

OTHER PUBLICATIONS

Chinese Office Action corresponding to Application No. 201480046628.3; dated Dec. 19, 2016.
(Continued)

*Primary Examiner* — Cephia D Toomer
(74) *Attorney, Agent, or Firm* — Cantor Colburn LLP

(57) ABSTRACT

A flame-retardant fabric may include a cellulosic fiber and a modacrylic fiber, the cellulosic fiber being a natural cellulose fiber containing a phosphorus compound, the modacrylic fiber containing an antimony compound, the flame-retardant fabric including the modacrylic fiber containing the antimony compound in an amount of 14 to 54 wt %, antimony in an amount of not less than 1.7 wt %, and phosphorus in an amount of 0.3 to 1.5 wt % with respect to the total weight of the flame-retardant fabric, and the flame-
(Continued)

retardant fabric having a weight per unit area of not less than 160 g/m$^2$. The flame-retardant fabric can be produced by subjecting a fabric including a natural cellulose fiber and a modacrylic fiber containing an antimony compound to flame-retardant treatment with a phosphorus compound.

16 Claims, 1 Drawing Sheet

(51) Int. Cl.

| | |
|---|---|
| ***D06M 13/282*** | (2006.01) |
| ***D03D 15/12*** | (2006.01) |
| ***D06M 13/447*** | (2006.01) |
| ***A62B 17/00*** | (2006.01) |
| ***D06M 11/47*** | (2006.01) |
| ***D06M 13/288*** | (2006.01) |
| ***D01F 1/07*** | (2006.01) |
| ***D01F 6/18*** | (2006.01) |
| ***D01F 6/38*** | (2006.01) |
| ***D01F 6/40*** | (2006.01) |
| ***D02G 3/44*** | (2006.01) |
| ***A41D 31/08*** | (2019.01) |
| *D06M 101/26* | (2006.01) |
| *D06M 101/06* | (2006.01) |
| *D06M 101/28* | (2006.01) |

(52) U.S. Cl.
CPC ..... *D01F 6/18* (2013.01); *D01F 6/38* (2013.01); *D01F 6/40* (2013.01); *D02G 3/443* (2013.01); *D03D 15/12* (2013.01); *D04B 1/16* (2013.01); *D06M 11/47* (2013.01); *D06M 13/282* (2013.01); *D06M 13/288* (2013.01); *D06M 13/447* (2013.01); *D06M 2101/06* (2013.01); *D06M 2101/26* (2013.01); *D06M 2101/28* (2013.01); *D06M 2200/30* (2013.01); *D10B 2201/01* (2013.01); *D10B 2321/10* (2013.01)

(58) Field of Classification Search
CPC ..... D06M 13/288; D06M 2101/26; D06M 2200/30; D06M 2101/06; D06M 2101/28; D03D 15/12; A62B 17/003; D01F 1/07; D01F 6/18; D01F 6/38; D01F 6/40; D10B 2201/01; D10B 2321/10
See application file for complete search history.

(56) References Cited

U.S. PATENT DOCUMENTS

| | | | | |
|---|---|---|---|---|
| 6,541,068 | B1 | 4/2003 | Galbraikh et al. | |
| 7,365,032 | B1 | 4/2008 | Adachi et al. | |
| 7,713,891 | B1 | 5/2010 | Li et al. | |
| 2003/0232560 | A1 | 12/2003 | Corner | |
| 2004/0062912 | A1* | 4/2004 | Mason | D04H 1/46 428/139 |
| 2006/0292953 | A1 | 12/2006 | Ashley et al. | |
| 2007/0190877 | A1 | 8/2007 | Mio et al. | |
| 2008/0254699 | A1 | 10/2008 | Mio et al. | |
| 2010/0047513 | A1* | 2/2010 | Hagi | D02G 3/42 428/91 |
| 2011/0250810 | A1 | 10/2011 | Zhu | |
| 2012/0042442 | A1 | 2/2012 | Takahashi et al. | |
| 2012/0156486 | A1 | 6/2012 | Bisjak et al. | |

FOREIGN PATENT DOCUMENTS

| | | | |
|---|---|---|---|
| CN | 1387591 | A | 12/2002 |
| CN | 101016694 | A | 8/2007 |
| EP | 1767677 | A1 | 1/2012 |
| EP | 2402488 | A1 | 1/2012 |
| JP | S5939549 | B | 9/1984 |
| JP | S5939549 | B2 | 9/1984 |
| JP | S59169549 | A | 9/1984 |
| JP | 2000199150 | A | 7/2000 |
| JP | 2008517181 | A | 5/2008 |
| JP | 2008184705 | A | 8/2008 |
| JP | 2012229509 | A | 11/2012 |
| JP | 2013524038 | A | 6/2013 |
| WO | 2006008900 | A1 | 1/2006 |
| WO | 2006043958 | A1 | 4/2006 |
| WO | 2006118009 | A1 | 11/2006 |
| WO | 2011126999 | A1 | 10/2011 |

OTHER PUBLICATIONS

International Search Report corresponding to Application No. PCT/JP2014/071975; dated Nov. 25, 2014, with English translation.
JPO Notification of Reasons for Refusal corresponding to JP Patent Application No. 2015-532911; dated Aug. 7, 2018.

* cited by examiner

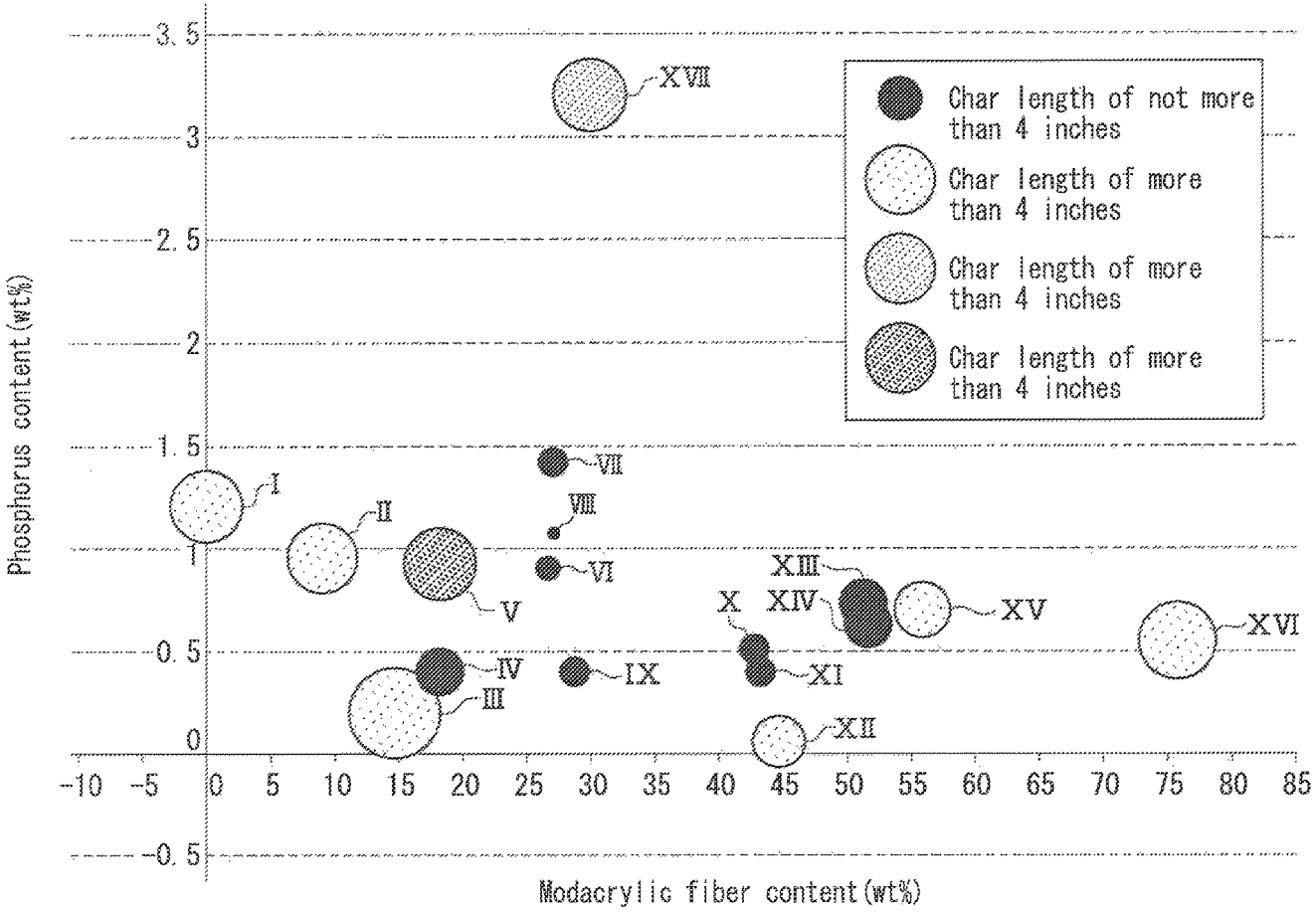
Char length of not more than 4 inches
Char length of more than 4 inches
Char length of more than 4 inches
Char length of more than 4 inches
Phosphorus content (wt%)
Modacrylic fiber content (wt%)
3.5
3
2.5
2
1.5
1
0.5
0
-0.5
-10
-5
0
5
10
15
20
25
30
35
40
45
50
55
60
65
70
75
80
85
I
II
III
IV
V
VI
VII
VIII
IX
X
XI
XII
XIII
XIV
XV
XVI
XVII

FLAME-RETARDANT FABRIC, METHOD FOR PRODUCING SAME AND FIREPROTECTIVE CLOTHES COMPRISING SAME

CROSS REFERENCE TO RELATED APPLICATIONS

This is the U.S. national stage of application No. PCT/JP2014/071975, filed on Aug. 22, 2014. Priority under 35 U.S.C. § 119(a) and 35 U.S.C. § 365(b) is claimed from Japanese Applications No. 2013-172976, filed Aug. 23, 2013; the disclosure of which is incorporated herein by reference.

TECHNICAL FIELD

At least an embodiment of the present invention relates to a flame-retardant fabric that can be used as a fabric for making fire-protective clothing, a method for producing the same, and fire-protective clothing including the same.

BACKGROUND

Firefighters and other workers who work in environments that are exposed to the danger of fires require fire-protective clothing having excellent durability and flame resistance, and usually an aramid fiber having high strength and flame resistance is used for a fabric for making fire-protective clothing. For example, Patent Document 1 discloses use of a woven fabric including a para-aramid fiber in an amount of about 40% to 70% and a meta-aramid fiber in an amount of about 10% to about 40% as an outer shell woven fabric for use in firefighter fire-protective clothing. Patent Document 2 proposes a fabric made from a yarn including a meta-aramid fiber in an amount of 50 to 80 wt % and a para-aramid fiber in an amount of 0 to 5 wt % as a fabric suitable for use in fire protection.

CITATION LIST

Patent Document

Patent Document 1: JP 2008-517181A
Patent Document 2: JP 2013-524038A

DISCLOSURE OF INVENTION

Problem to be Solved by the Invention

However, the fabrics disclosed in the above-described patent documents include an aramid fiber at a high blending ratio. A high blending ratio of an aramid fiber results in increases in product prices and thus constitutes an obstacle to the spread of safe products.

SUMMARY

To address the above-described problem with related art, at least an embodiment of the present invention provides an inexpensive flame-retardant fabric having excellent flame resistance and durability and inexpensive fire-protective clothing including the flame-retardant fabric, and provides a method for producing a flame-retardant fabric, the method enabling the production of an inexpensive flame-retardant fabric having excellent flame resistance and durability.

Means for Solving Problem

At least an embodiment of the present invention relates to a flame-retardant fabric including a cellulosic fiber and a modacrylic fiber, wherein the cellulosic fiber is a natural cellulose fiber containing a phosphorus compound, the modacrylic fiber contains an antimony compound, the flame-retardant fabric includes the modacrylic fiber containing the antimony compound in an amount of 14 to 54 wt %, antimony in an amount of not less than 1.7 wt %, and phosphorus in an amount of 0.3 to 1.5 wt % with respect to a total weight of the flame-retardant fabric, and the flame-retardant fabric has a weight per unit area of not less than 160 g/m$^2$.

In at least an embodiment, the flame-retardant fabric has a tear strength of not less than 1.5 kgf, the tear strength being measured through a tear strength test based on ASTM D1424 pendulum method. In at least an embodiment, the flame-retardant fabric includes the antimony-containing modacrylic fiber in an amount of 18 to 45 wt % and more preferably in an amount of 22 to 35 wt % with respect to the total weight of the flame-retardant fabric. In at least an embodiment, in the natural cellulose fiber containing the phosphorus compound, the phosphorus compound is bound to a cellulose molecule or forms an insoluble polymer in the fiber, and in at least an embodiment, the modacrylic fiber containing the antimony compound contains the antimony compound in an amount of 1.6 to 33 wt % with respect to a total weight of the fiber. In at least an embodiment, the antimony compound is one or more compounds selected from the group consisting of antimony trioxide, antimony tetraoxide, and antimony pentoxide. In at least an embodiment, the flame-retardant fabric has a char length of not more than 4 inches, the char length being measured through a flame retardancy test based on ASTM D6413-08. In at least an embodiment, the flame-retardant fabric includes phosphorus in an amount of 0.3 to 1.1 wt % with respect to the total weight of the flame-retardant fabric. Moreover, in at least an embodiment, the flame-retardant fabric has a weight per unit area of 160 to 280 g/m$^2$.

At least an embodiment of the present invention also relates to a method for producing the above-described flame-retardant fabric, wherein a fabric including a natural cellulose fiber and a modacrylic fiber containing an antimony compound is subjected to flame-retardant treatment with a phosphorus compound.

In the method for producing a flame-retardant fabric according to at least an embodiment of the present invention, the flame-retardant treatment is performed by Pyrovatex treatment or ammonia curing using a tetrakis hydroxyalkyl phosphonium salt. In at least an embodiment, the phosphorus compound is an N-methylol phosphonate compound or a tetrakis hydroxyalkyl phosphonium salt.

At least an embodiment of the present invention also relates to fire-protective clothing including the above-described flame-retardant fabric.

Effects of the Invention

According to at least an embodiment of the present invention, a fabric includes a natural cellulose fiber containing a phosphorus compound and an modacrylic fiber containing a antimony compound, the fabric contains the modacrylic fiber containing the antimony compound in an amount of 14 to 54 wt %, antimony in an amount of not less than 1.7 wt %, and phosphorus in an amount of of 0.3 to 1.5 wt % with respect to the total weight of the fabric, and the fabric has a weight per unit area of not less than 160 g/m$^2$. Thus, an inexpensive flame-retardant fabric having excellent flame resistance and durability and inexpensive fire-protective clothing including this flame-retardant fabric can be provided. Moreover, according to at least an embodiment of the present invention, a fabric including a natural cellulose fiber and a modacrylic fiber containing an antimony compound is subjected to flame-retardant treatment with a phosphorus compound. Thus, an inexpensive flame-retardant fabric having excellent flame resistance and durability can be produced.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which:

FIG. 1 is a graph illustrating the modacrylic fiber content, the phosphorous content, and the char length in a flame resistance evaluation, with respect to flame-retardant fabrics of examples and comparative examples.

DETAILED DESCRIPTION

As a result of in-depth research on fabrics for making fire-protective clothing that include no aramid fiber, the inventors surprisingly found that subjecting a fabric including a natural cellulose fiber and an modacrylic fiber containing a antimony compound (hereinafter also referred to as an antimony-containing modacrylic fiber) to flame-retardant treatment with a phosphorus compound and setting the modacrylic fiber content, antimony content, and phosphorus content with respect to the total weight of the fabric as well as the weight per unit area of the fabric to specified ranges allow the fabric to have excellent durability while having high flame resistance even though the fabric includes no aramid fiber Since the flame-retardant fabric of at least an embodiment of the present invention does not need to include an aramid fiber, an inexpensive product can be provided.

In at least an embodiment of the present invention, the flame resistance of the flame-retardant fabric can be evaluated using the char length measured through a flame resistance test based on ASTM D6413-08 (hereinafter also referred to simply as the char length). The smaller the value of the char length, the better the flame resistance.

In at least an embodiment of the present invention, the durability of the flame-retardant fabric can be evaluated using the tear strength measured through a tear strength test based on the ASTM D1424 pendulum method (hereinafter also referred to simply as the tear strength). The higher the value of the tear strength, the better the durability.

In at least an embodiment, the modacrylic fiber is composed of an acrylonitrile copolymer obtained by copolymerizing acrylonitrile in an amount of 35 to 85 wt % and other components in an amount of 15 to 65 wt %. For example, a halogen-containing vinyl and/or halogen-containing vinylidene monomer and the like can be used as the other components. It is more preferable that the acrylonitrile copolymer contains acrylonitrile in an amount of 35 to 65 wt %. It is more preferable that the acrylonitrile copolymer contains the halogen-containing vinyl and/or halogen-containing vinylidene monomer in an amount of 35 to 65 wt %. The acrylonitrile copolymer may further include a monomer containing a sulfonic acid group. The content of the sulfonic acid group-containing monomer in the acrylonitrile copolymer is preferably 0 to 3 wt %.

When the acrylonitrile copolymer contains acrylonitrile in an amount of 35 to 85 wt %, the physical properties of the modacrylic fiber are favorable, and accordingly the physical properties of the flame-retardant fabric including the modacrylic fiber are also favorable.

When the acrylonitrile copolymer contains the halogen-containing vinyl and/or halogen-containing vinylidene monomer in an amount of 15 to 65 wt %, the flame resistance of the modacrylic fiber is favorable, and accordingly the flame resistance of the flame-retardant fabric including the modacrylic fiber is also favorable.

Examples of the halogen-containing vinyl and/or halogen-containing vinylidene monomer include vinyl chloride, vinylidene chloride, vinyl bromide, and vinylidene bromide. These halogen-containing vinyl and/or halogen-containing vinylidene monomers may be used alone or in combination of two or more.

Examples of the sulfonic acid group-containing monomer include methacrylsulfonic acid, allylsulfonic acid, styrenesulfonic acid, 2-acrylamide-2-methylpropanesulfonic acid, and their salts. Examples of the aforementioned salts include, but not limited to, a sodium salt, a potassium salt, and an ammonium salt. These sulfonic acid group-containing monomers may be used alone or in combination of two or more. The sulfonic acid group-containing monomer may be used as necessary, and when the content of the sulfonic acid group-containing monomer in the acrylonitrile copolymer is not more than 3 wt %, the production stability of a spinning process is excellent.

The modacrylic fiber contains an antimony compound. The modacrylic fiber contains the antimony compound preferably in an amount of 1.6 to 33 wt % and more preferably in an amount of 3.8 to 21 wt % with respect to the total weight of the fiber. When the antimony compound content in the modacrylic fiber falls within the above-described ranges, the production stability of the spinning process is excellent, and the flame resistance is favorable.

Examples of the antimony compound include antimony trioxide, antimony tetraoxide, antimony pentoxide, antimonic acid, salts of antimonic acid such as sodium antimonate, and antimony oxychloride, and these antimony compounds may be used alone or in combination of two or more. In terms of the production stability of the spinning process, in at least an embodiment, the antimony compound is one or more compounds selected from the group consisting of antimony trioxide, antimony tetraoxide, and antimony pentoxide.

Commercially available modacrylic fibers such as "Protex" (registered trademark) C type or M type manufactured by Kaneka Corporation, for example, can be used as the modacrylic fiber containing the antimony compound.

The flame-retardant fabric contains the antimony-containing modacrylic fiber in an amount of 14 to 54 wt %, preferably in an amount of 18 to 45 wt %, and more preferably in an amount of 22 to 35 wt % with respect to the total weight of the fabric. When the flame-retardant fabric contains the antimony-containing modacrylic fiber in an amount of less than 14 wt %, the char length of the flame-retardant fabric that is measured through a flame resistance test based on ASTM D6413-08 is long, and the flame resistance is low. Moreover, when the flame-retardant fabric contains the antimony-containing modacrylic fiber in an amount of more than 54 wt %, the char length measured through a flame resistance test based on ASTM D6413-08 is long as well, and the flame resistance is low. The flame-retardant fabric may include one or two or more antimony-containing modacrylic fibers or may include two or more modacrylic fibers having different antimony contents. According to at least an embodiment of the present invention, since it was found that both excessively low and excessively high modacrylic fiber contents in a flame-retardant fabric including a cellulosic fiber and an antimony-containing modacrylic fiber result in deterioration of the flame resistance, the modacrylic fiber content is set to a range of 14 to 54 wt % with respect to the total weight of the fabric, and thus a flame-retardant fabric having excellent flame resistance is provided.

The flame-retardant fabric contains antimony in an amount of not less than 1.7 wt %, preferably in an amount of 3.0 to 18 wt %, and more preferably in an amount of 3.0 to 12 wt % with respect to the total weight of the flame-retardant fabric. When the antimony content in the flame-retardant fabric is less than 1.7 wt %, the char length of the flame-retardant fabric that is measured through a flame resistance test based on ASTM D6413-08 is long, and the flame-retardant fabric has poor flame resistance. When the flame-retardant fabric contains antimony in an amount of not more than 18 wt % with respect to the total weight of the fabric, the processability during production of the fabric improves.

Any natural cellulose fiber can be used as the cellulosic fiber, and there is no particular limitation on the natural cellulose fiber. For example, cotton, kapok, flax (linen), ramie, jute, or the like can be used. These natural cellulose fibers may be used alone or in combination of two or more.

In the flame-retardant fabric, the natural cellulose fiber contains a phosphorus compound. With regard to the phosphorus compound, a natural cellulose fiber can be made to contain a phosphorus compound by, for example, subjecting the fabric including the natural cellulose fiber and the antimony-containing modacrylic fiber to flame-retardant treatment with the phosphorus compound, as will be described later.

In the flame-retardant fabric, the natural cellulose fiber provides strength to the flame-retardant fabric, thereby improving the durability of the flame-retardant fabric. In particular, as the combined effect of the natural cellulose fiber, the antimony-containing modacrylic fiber, and phosphorus (phosphorus compound), the char length of the flame-retardant fabric that is measured through a flame resistance test based on ASTM D6413-08 is short, and the flame-retardant fabric has high flame resistance. In the case of a regenerated cellulose fiber, the fiber itself has low strength. Accordingly, even when a regenerated cellulose fiber is used together with the antimony-containing modacrylic fiber and phosphorus (phosphorus compound), the char length of the resulting fabric that is measured through a method of determining the char length by tearing a sample after a burning test as in a flame resistance test based on ASTM D6413-08 is long, and this means that the flame resistance is poor.

The flame-retardant fabric contains the natural cellulose fiber containing the phosphorus compound preferably in an amount of 46 to 86 wt %, more preferably in an amount of 55 to 82 wt %, and even more preferably in an amount of 65 to 78 wt % with respect to the total weight of the flame-retardant fabric. When the content of the natural cellulose fiber in the flame-retardant fabric falls within the above-described ranges, the flame resistance and durability of the flame-retardant fabric can be improved, and the flame-retardant fabric can also have excellent texture and moisture-absorbing properties.

The flame-retardant fabric includes phosphorus in an amount of 0.3 to 1.5 wt %, preferably in an amount of 0.3 to 1.1 wt %, more preferably in an amount of 0.4 to 1.0 wt %, and even more preferably in an amount of 0.5 to 0.9 wt % with respect to the total weight of the flame-retardant fabric. When the phosphorus content in the flame-retardant fabric is less than 0.3 wt %, the char length of the flame-retardant fabric that is measured through a flame resistance test based on ASTM D6413-08 is long, and the flame resistance is low. When the phosphorus content in the flame-retardant fabric is more than 1.5 wt %, the tear strength of the flame-retardant fabric that is measured through a tear strength test based on the ASTM D1424 pendulum method is low, and the durability is poor. Moreover, an excessively high phosphorus content in the flame-retardant fabric results in low tear strength and hence a long char length, and the flame resistance is low.

In the flame-retardant fabric, phosphorus is derived from the phosphorus compound contained in the natural cellulose fiber. In at least an embodiment, the phosphorus compound is bound to cellulose molecules of the natural cellulose fiber or forms an insoluble polymer in the natural cellulose fiber, because the flame resistance is not lowered by washing, and thus excellent washing durability is achieved.

In addition to the natural cellulose fiber containing the phosphorus compound and the antimony-containing modacrylic fiber, the flame-retardant fabric may also include other fibers, as necessary, to the extent that the effects of at least an embodiment of the present invention are not inhibited. Examples of the other fibers include a nylon fiber, an aramid fiber, and a polyester fiber. The flame-retardant fabric can include the other fibers in an amount of 0 to 20 wt % with respect to the total weight of the flame-retardant fabric.

In terms of the strength, the modacrylic fiber preferably has a fineness of 1 to 20 dtex and more preferably 1.5 to 15 dtex, and the natural cellulose fiber preferably has a fineness of 0.5 to 20 dtex and more preferably 1 to 3 dtex. Moreover, in terms of the strength, the modacrylic fiber preferably has a fiber length of 38 to 127 mm and more preferably 38 to 76 mm, and the natural cellulose fiber preferably has a fiber length of 15 to 38 mm and more preferably 20 to 38 mm.

The flame-retardant fabric has a weight per unit area of not less than 160 g/m$^2$, preferably not less than 200 g/m$^2$, and more preferably not less than 230 g/m$^2$. When the flame-retardant fabric has a weight per unit area of less than 160 g/m$^2$, the tear strength of the flame-retardant fabric that is measured through a tear strength test based on the ASTM D1424 pendulum method is low, and the durability is poor. Moreover, in order to achieve excellent texture, the weight per unit area of the flame-retardant fabric is preferably less than 300 g/m$^2$ and more preferably not more than 280 g/m$^2$.

The content of the modacrylic fiber (containing the antimony compound) or the natural cellulose fiber (containing the phosphorus compound) in the flame-retardant fabric can be measured in conformity with the dissolution method specified in JIS L 1030 as will be described later.

The antimony or phosphorus content in the flame-retardant fabric can be measured through fluorescent X-ray analysis as will be described later.

Hereinafter, a method for producing the flame-retardant fabric of at least an embodiment of the present invention will be described. Preferably, the flame-retardant fabric of at least an embodiment of the present invention is produced by subjecting a fabric including a natural cellulose fiber and an antimony-containing modacrylic fiber to flame-retardant treatment with a phosphorus compound.

The fabric including the natural cellulose fiber and the antimony-containing modacrylic fiber can be produced by a known fabric production method using a yarn produced by a known spinning method. Examples of the form of the fabric include, but not limited to, woven fabric, knitted fabric, and the like. Also, the woven fabric may be a mixed weave fabric, and the knitted fabric may be a mixed knit fabric.

There is no particular limitation on the type of weave of the woven fabric, and the woven fabric may be woven with one of the three basic weaves, that is, the plain weave, the twill weave, or the satin weave, for example, or may be a patterned woven fabric made by means of a special weaving machine such as a dobby or a jacquard. Also, there is no particular limitation on the type of stitch of the knitted fabric, and the knitted fabric may be knitted by any of circular knitting, weft knitting (e.g., plain stitch knitted fabric), and warp knitting. In order to achieve high tear strength and excellent durability, the fabric is preferably a woven fabric and more preferably a woven fabric woven with the twill weave.

In the fabric including the natural cellulose fiber and the antimony-containing modacrylic fiber, the weight per unit area of the fabric, the natural cellulose fiber content, the antimony-containing modacrylic fiber content, and the like can be appropriately adjusted in accordance with the desired weight per unit area, antimony-containing modacrylic fiber content, antimony content, phosphorus content, and the like of the resulting flame-retardant fabric.

The flame-retardant treatment with the phosphorus compound allows the phosphorus compound to be present in the surface and/or the inside of the natural cellulose fiber constituting the fabric. In terms of the elution of the phosphorus compound and the washing durability, in at least an embodiment, the phosphorus compound is bound to cellulose molecules of the natural cellulose fiber or forms an insoluble polymer in the cellulose fiber.

In at least an embodiment, the phosphorus compound is a phosphorus compound that easily binds to cellulose molecules of the natural cellulose fiber or a phosphorus compound that easily forms an insoluble polymer in the cellulose fiber. Preferably, an N-methylol phosphonate compound or a tetrakis hydroxyalkyl phosphonium salt is used as the phosphorus compound. The N-methylol phosphonate compound easily reacts with cellulose molecules and binds to the cellulose molecules. For example, N-methylol dimethyl phosphonocarboxylic acid amides including N-methylol dimethyl phosphonopropionamide and the like can be used as the N-methylol phosphonate compound. The tetrakis hydroxyalkyl phosphonium salt easily forms an insoluble polymer in the cellulosic fiber. For example, tetrakis hydroxymethyl phosphonium salts such as tetrakis hydroxymethyl phosphonium chloride (THPC) and tetrakis hydroxymethyl phosphonium sulfate (THPS) can be used as the tetrakis hydroxyalkyl phosphonium salt.

There is no particular limitation on the flame-retardant treatment with the phosphorus compound. However, in order to bind the phosphorus compound to cellulose molecules of the natural cellulose fiber, the treatment is preferably performed by Pyrovatex treatment, for example. Pyrovatex treatment can be performed by a known typical procedure such as that described in technical literature regarding Pyrovatex CP of Huntsman, for example. Moreover, although there is no particular limitation on the flame-retardant treatment with the phosphorus compound, In at least an embodiment, the treatment is performed by, for example, ammonia curing (hereinafter also described as THP-ammonia curing) using a tetrakis hydroxyalkyl phosphonium salt such as a tetrakis hydroxymethyl phosphonium salt so that the phosphorus compound easily forms an insoluble polymer in the cellulose fiber. THP-ammonia curing can be performed by a known typical procedure such as that described in, for example, JP S59-39549B or the like.

In the case where Pyrovatex treatment is performed, an N-methylol phosphonate compound, for example, can be used as the phosphorus compound for Pyrovatex treatment. For example, N-methylol dimethyl phosphonocarboxylic acid amides including N-methylol dimethyl phosphonopropionamide and the like can be used as the N-methylol phosphonate compound. Specifically, a commercially available compound such as a compound manufactured by Huntsman under the trade name "Pyrovatex CP NEW" can be used as the N-methylol dimethyl phosphonopropionamide. The fabric including the natural cellulose fiber and the antimony-containing modacrylic fiber is impregnated with a flame-retardant treatment liquid (Pyrovatex treatment agent) including the phosphorus compound for Pyrovatex treatment, such as N-methylol dimethyl phosphonopropionamide. After the flame-retardant treatment liquid sufficiently penetrates the fabric, the fabric is squeezed at a predetermined squeezing rate, pre-dried, and heat-treated to bind the phosphorus compound to cellulose molecules of the natural cellulose fiber. The concentration of the N-methylol phosphonate compound, such as N-methylol dimethyl phosphonopropionamide or an N-methylol dimethyl phosphonocarboxylic acid amide, in the flame-retardant treatment liquid (treatment agent) is not particularly limited, but may be preferably 50 to 600 g/L, more preferably 50 to 400 g/L, and even more preferably 100 to 400 g/L. The temperature at which the aforementioned pre-drying is performed is not particularly limited, but may be preferably 100 to 120° C. and more preferably 105 to 115° C. The pre-drying time is not particularly limited, but may be, for example, preferably 1 to 10 minutes and more preferably 3 to 5 minutes. The temperature at which the aforementioned heat treatment is performed is not particularly limited, but may be preferably 150 to 170° C. and more preferably 150 to 160° C. The heat treatment time is not particularly limited, but may be, for example, preferably 1 to 10 minutes and more preferably 3 to 7 minutes.

In the case where Pyrovatex treatment is performed, in order to increase the ability of the phosphorus compound to penetrate the fabric, In at least an embodiment, the flame-retardant treatment liquid further includes a penetrant. There is no particular limitation on the penetrant; however, for example, a penetrant manufactured by Huntsman under the trade name "Invadine PBN" or the like can be used. Moreover, the flame-retardant treatment liquid may also include a catalyst that promotes an esterification reaction of hydroxyl groups of the cellulosic fiber. There is no particular limitation on the catalyst; however, for example, phosphoric acid or the like can be used. In order to increase the crease resistance of the fabric, in at least an embodiment, the flame-retardant treatment liquid further includes a cross-linking agent. There is no particular limitation on the cross-linking agent; however, for example, a melamine-based resin, a urea-based resin, or the like can be used. There is no particular limitation on the melamine-based resin; however, for example, hexamethoxymethylol melamine or the like can be used. Specifically, a product manufactured by DIC under the trade name "Beckamine J-101" or the like can be used as hexamethoxymethylol melamine.

In the case where THP-ammonia curing is performed, for example, a flame-retardant treatment liquid (treatment agent) including a water soluble nitrogen-containing phosphonium olygomer obtained by performing heating condensation of the tetrakis hydroxyalkyl phosphonium salt such as tetrakis hydroxymethyl phosphonium chloride or tetrakis hydroxymethyl phosphonium sulfate is used. The fabric including the natural cellulose fiber and the antimony-containing modacrylic fiber is impregnated with the flame retardant treatment liquid. After the flame-retardant treatment liquid sufficiently penetrates the fabric, an insoluble polymer is formed in the natural cellulose fiber by reaction with ammonium gas.

Moreover, in order to improve the softness and the feel of the flame-retardant fabric, the flame-retardant treatment liquid may also include a softening agent in both of the cases where Pyrovatex treatment is performed and where THP-ammonia curing is performed. A silicon-based softening agent or the like can be used as the softening agent.

The phosphorus content in the resulting flame-retardant fabric can be adjusted by adjusting the concentration of the phosphorus compound in the flame-retardant treatment liquid, the squeezing rate after penetration of the flame-retardant treatment liquid, the heat treatment temperature during the flame-retardant treatment, and the like.

The flame-retardant fabric of at least an embodiment of the present invention has excellent flame resistance, and in at least an embodiment, the char length thereof measured through a flame resistance test based on ASTM D6413-08 is not more than 4 inches. A char length of not more than 4 inches meets the requirements of the NFPA 2112 vertical test.

Moreover, the flame-retardant fabric of at least an embodiment of the present invention has excellent durability, and the tear strength thereof measured through a tear strength test based on the ASTM D1424 pendulum method is preferably more than 1.4 kgf and more preferably not less than 1.5 kgf. A tear strength of not less than 1.5 kgf meets the tear strength requirements specified in "ISO 11612 protective clothing standards".

The fire-protective clothing of at least an embodiment of the present invention can be produced by a known sewing method using the above-described flame-retardant fabric. Since the flame-retardant fabric has excellent flame resistance and durability, the fire-protective clothing of at least an embodiment of the present invention also has excellent flame resistance and durability. The flame-retardant fabric can be used as a fabric for making single-layer fire-protective clothing and can also be used as a fabric for making multilayer fire-protective clothing. In the case of the multilayer fire-protective clothing, the flame-retardant fabric may be used for all of the layers or may be used for some of the layers. When the flame-retardant fabric is used for some layers of multilayer fire-protective clothing, In at least an embodiment, the flame-retardant fabric is used for an outer layer. Moreover, the fire-protective clothing maintains its flame resistance even after repeated washing.

EXAMPLES

Hereinafter, at least an embodiment of the present invention will be described in detail using examples. However, the present invention is not limited to these examples.

Fibers used in examples and comparative examples below are as follows:

Fibers

Modacrylic fibers composed of an acrylic copolymer constituted by 50 wt % acrylonitrile, 49 wt % vinylidene chloride, and 1 wt % sodium styrene sulfonate and having the following antimony compound contents were used as the modacrylic fiber. Modacrylic fiber A: modacrylic fiber containing antimony trioxide in an amount of 21 wt % with respect to the total weight of the fiber (fineness: 2.2 dtex, fiber length: 38 mm) Modacrylic fiber B: modacrylic fiber containing antimony trioxide in an amount of 3.8 wt % with respect to the total weight of the fiber (fineness: 1.9 dtex, fiber length: 38 mm) Modacrylic fiber C: modacrylic fiber containing antimony trioxide in an amount of 9.1 wt % with respect to the total weight of the fiber (fineness: 1.7 dtex, fiber length: 38 mm) Modacrylic fiber D: modacrylic fiber containing antimony pentoxide in an amount of 4.8 wt % with respect to the total weight of the fiber (fineness: 1.7 dtex, fiber length 38 mm) Modacrylic fiber E: modacrylic fiber containing antimony pentoxide in an amount of 7.0 wt % with respect to the total weight of the fiber (fineness: 1.7 dtex, fiber length 38 mm)

Commercially available cotton (medium-staple cotton) was used as the natural cellulose fiber.

Lenzing FR (fineness: 1.7 dtex, fiber length 40 mm) was used as a flame retardant rayon fiber (FR rayon).

Example 1

Production of Fabric

The natural cellulose fiber and the antimony-containing modacrylic fiber were blended in accordance with a raw cotton composition shown in Table 1 below, and spun into yarns by ring spinning. The resultant spun yarns were blended yarns having an English cotton count of 20. A twill woven fabric (untreated fabric) having the weight per unit area shown in Table 1 below was produced by an ordinary weaving method using these spun yarns.

Flame-Retardant Treatment

Flame-retardant treatment of the obtained untreated fabric was performed by Pyrovatex treatment using a phosphorus compound. First, a flame-retardant treatment liquid (treatment agent) including a phosphorus compound (trade name "Pyrovatex CP NEW", manufactured by Huntsman, N-methylol dimethyl phosphonopropionamide) in a concentration of 400 g/L, a cross-linking agent (trade name "Beckamine J-101", manufactured by DIC, hexamethoxymethylol melamine) in a concentration of 60 g/L, a softening agent (trade name "Ultratex FSA NEW", manufactured by Huntsman, silicon-based softening agent) in a concentration of 30 g/L, 85% phosphoric acid in a concentration of 20.7 g/L, and a penetrant (trade name "Invadine PBN", manufactured by Huntsman) in a concentration of 5 ml/L was prepared. After the flame-retardant treatment liquid sufficiently penetrated the fabric, the flame-retardant treatment liquid was squeezed from the fabric using a dehydrator such that the squeezing rate was 80±2%. Then, the fabric was dried at 110° C. for 5 minutes and heat-treated at 150° C. for 5 minutes. After that, the fabric was washed with an aqueous sodium carbonate solution and water, neutralized with a hydrogen peroxide solution, washed with water, and dehydrated. Then, the fabric was dried at 60° C. for 30 minutes using a tumble dryer, and thus a flame-retardant fabric was obtained.

Examples 2 to 9 and Comparative Examples 1 to 11

Production of Fabrics

The natural cellulose fiber and the antimony-containing modacrylic fiber were blended in accordance with raw cotton compositions shown in Table 1 below, and spun into yarns by ring spinning. The resultant spun yarns were blended yarns having an English cotton count of 20. Twill woven fabrics (untreated fabrics) each having the weight per unit area shown in Table 1 below were produced by an ordinary weaving method using these spun yarns.

Flame-Retardant Treatment

Flame-retardant treatment was performed in the same manner as in Example 1 except that treatment agents (flame-retardant treatment liquids) formulated as shown in Table 1 below were used for flame-retardant treatment of the untreated fabrics, and thus flame-retardant fabrics were obtained.

Table 1 below also shows the amount of solid component adhering to the flame-retardant fabrics of Examples 1 to 9 and Comparative Examples 1 to 11. The amount of adhering solid component was obtained by measuring the weight of the untreated fabric that was used in flame-retardant treatment and the weight of the flame-retardant fabric after flame-retardant treatment and performing a calculation based on an equation below.

Amount of adhering solid component (wt %)= [(weight of flame-retardant fabric−weight of untreated fabric)/weight of untreated fabric]×100

Comparative Example 12

A twill woven fabric (flame-retardant fabric) having a weight per unit area of 240 g/m$^2$ was produced by an ordinary weaving method using spun yarns (blended yarns) constituted by the modacrylic fiber A in an amount of 30 parts by weight and the FR rayon (Lenzing FR) in an amount of 70 parts by weight and having an English cotton count of 20.

TABLE 1

| | Untreated fabric | | | Formulation of treatment agent | | | | | Amount of adhering |
|---|---|---|---|---|---|---|---|---|---|
| | Type and blending amount of antimony-containing modacrylic fiber (parts by weight) | Blending amount of cotton (parts by weight) | Weight per unit area (g/m$^2$) | Pyrovatex CP (g/L) | Beckamine (g/L) | Ultratex (g/L) | Invadine PBN (ml/L) | Phosphoric acid (g/L) | solid component (%) |
| Ex. 1 | Modacrylic fiber A: 55 | 45 | 168 | 400 | 60 | 30 | 5 | 20.7 | 7.5 |
| Ex. 2 | Modacrylic fiber A: 45 | 55 | 266 | 200 | 30 | 15 | 2.5 | 10.4 | 5.1 |
| Ex. 3 | Modacrylic fiber C: 55 | 45 | 169 | 400 | 60 | 30 | 5 | 20.7 | 7.0 |
| Ex. 4 | Modacrylic fiber A: 30 | 70 | 240 | 100 | 15 | 7.5 | 1.25 | 5.2 | 4.2 |
| Ex. 5 | Modacrylic fiber A: 45 | 55 | 288 | 100 | 15 | 7.5 | 1.25 | 5.2 | 4.0 |
| Ex. 6 | Modacrylic fiber A: 30 | 70 | 200 | 300 | 60 | 30 | 5 | 20.7 | 11.5 |
| Ex. 7 | Modacrylic fiber A: 30 | 70 | 200 | 400 | 60 | 30 | 5 | 20.7 | 10.5 |
| Ex. 8 | Modacrylic fiber A: 30 | 70 | 200 | 600 | 60 | 30 | 5 | 20.7 | 11.0 |
| Ex. 9 | Modacrylic fiber A: 30 | 70 | 190 | 350 | 60 | 30 | 5 | 20.7 | 9.5 |
| Com. Ex. 1 | 0 | 100 | 166 | 400 | 60 | 30 | 5 | 20.7 | 12.0 |
| Com. Ex. 2 | Modacrylic fiber A: 10 | 90 | 180 | 400 | 60 | 30 | 5 | 20.7 | 9.5 |
| Com. Ex. 3 | Modacrylic fiber C: 80 | 20 | 223 | 400 | 60 | 30 | 5 | 20.7 | 5.5 |
| Com. Ex. 4 | Modacrylic fiber A: 80 | 20 | 147 | 400 | 60 | 30 | 5 | 20.7 | 6.0 |
| Com. Ex. 5 | Modacrylic fiber B: 20 | 80 | 202 | 400 | 60 | 30 | 5 | 20.7 | 9.2 |
| Com. Ex. 6 | Modacrylic fiber A: 45 | 55 | 287 | 50 | 7.5 | 3.75 | 0.63 | 2.6 | 0.6 |
| Com. Ex. 7 | Modacrylic fiber A: 30 | 70 | 200 | 100 | 60 | 30 | 5 | 20.7 | 7.5 |
| Com. Ex. 8 | Modacrylic fiber A: 30 | 70 | 140 | 400 | 60 | 30 | 5 | 20.7 | 10.7 |
| Com. Ex. 9 | Modacrylic fiber A: 60 | 40 | 156 | 400 | 60 | 30 | 5 | 20.7 | 7.3 |
| Com. Ex. 10 | Modacrylic fiber A: 15 | 85 | 191 | 100 | 15 | 7.5 | 1.25 | 5.2 | 1.8 |
| Com. Ex. 11 | Modacrylic fiber A: 30 | 70 | 190 | 700 | 60 | 30 | 5 | 20.7 | 9.5 |

Ex.: Example

Com. Ex.: Comparative Example

Examples 10 to 17 and Comparative Examples 13 and 14

Production of Fabrics

The natural cellulose fiber and the antimony-containing modacrylic fiber were blended in accordance with raw cotton compositions shown in Table 2 below, and spun into yarns by ring spinning. The resultant spun yarns were blended yarns having an English cotton count of 20. Plain stitch knitted fabrics (untreated fabrics) each having the weight per unit area shown in Table 2 below were produced by an ordinary production method using these spun yarns.

Flame-Retardant Treatment

Flame-retardant treatment was performed in the same manner as in Example 1 except that treatment agents (flame-retardant treatment liquids) formulated as shown in Table 2 below were used for flame-retardant treatment of the untreated fabrics, and thus flame-retardant fabrics were obtained.

TABLE 2

| | Untreated fabric | | | Formulation of treatment agent | | | | | Amount of adhering |
|---|---|---|---|---|---|---|---|---|---|
| | Type and blending amount of antimony-containing modacrylic fiber (parts by weight) | Blending amount of cotton (parts by weight) | Weight per unit area ($g/m^2$) | Pyrovatex CP (g/L) | Beckamine (g/L) | Ultratex (g/L) | Invadine PBN (ml/L) | Phosphoric acid (g/L) | solid component (%) |
| Ex. 10 | Modacrylic fiber D: 55 | 45 | 175 | 400 | 60 | 30 | 5 | 20.7 | 8.1 |
| Ex. 11 | Modacrylic fiber E: 40 | 60 | 181 | 300 | 45 | 23 | 3.8 | 15.6 | 8.2 |
| Ex. 12 | Modacrylic fiber E: 55 | 45 | 178 | 400 | 60 | 30 | 5 | 20.7 | 7.9 |
| Ex. 13 | Modacrylic fiber A: 30 | 70 | 175 | 200 | 30 | 15 | 2.5 | 10.4 | 8.4 |
| Ex. 14 | Modacrylic fiber C: 30 | 70 | 177 | 300 | 45 | 23 | 3.8 | 15.6 | 10.5 |
| Ex. 15 | Modacrylic fiber C: 30 | 70 | 183 | 100 | 15 | 7.5 | 1.25 | 5.2 | 4.0 |
| Ex. 16 | Modacrylic fiber A: 20 | 80 | 183 | 100 | 15 | 7.5 | 1.25 | 5.2 | 4.0 |
| Ex. 17 | Modacrylic fiber A: 20 | 80 | 178 | 300 | 45 | 23 | 3.8 | 15.6 | 10.5 |
| Com. Ex. 13 | Modacrylic fiber C: 30 | 70 | 185 | 50 | 7.5 | 3.75 | 0.63 | 2.6 | 2.5 |
| Com. Ex. 14 | Modacrylic fiber B: 40 | 60 | 172 | 300 | 45 | 23 | 3.8 | 15.6 | 8.2 |

With respect to the flame-retardant fabrics obtained in Examples 1 to 17 and Comparative Examples 1 to 14, the weight per unit area, the modacrylic fiber (antimony-containing modacrylic fiber) content, the cellulosic fiber (natural cellulose fiber containing phosphorus compound) content, the antimony (Sb) content, and the phosphorus content were measured in the following manners. Tables 3 and 4 below show the results. Moreover, with respect to the flame-retardant fabrics obtained in Examples 1 to 9 and Comparative Examples 1 to 12, the flame resistance, the tear strength, and the texture were measured and evaluated in the following manners. Table 3 below shows the results. Furthermore, with respect to the flame-retardant fabrics obtained in Examples 10 to 17 and Comparative Examples 13 and 14, the flame resistance was measured and evaluated in the following manner. Table 4 below shows the results.

Weight Per Unit Area

Each fabric was cut along a 10 cm×10 cm frame, the weight of the cut fabric was measured, and the weight per unit area was calculated.

Modacrylic Fiber Content

The modacrylic fiber content in each flame-retardant fabric was measured in conformity with the JIS L 1030 dissolution method. About 1.0 g sample (flame-retardant fabric) was precisely weighed, and stirred for 20 minutes in dimethylformamide at 50° C. in an amount that was 100 times the sample weight to dissolve the modacrylic fiber (containing the antimony compound). The resultant mixture was filtered by suction filtration. After that, the residue on a funnel was washed successively with dimethylformamide at 50° C. in an amount that was 100 times the sample weight and with hot water at 50° C. in an amount that was 100 times the sample weight. Then, the residue was dried. The weight of the residue after drying was measured, and the modacrylic fiber content in the flame-retardant fabric was calculated using an equation below.

Modacrylic fiber content in flame-retardant fabric (wt %)=[(sample weight−weight of residue after drying)/sample weight]×100

Cellulosic Fiber Content

The cellulosic fiber content in each flame-retardant fabric was measured in conformity with the JIS L 1030 dissolution method. About 1.0 g sample (flame-retardant fabric) was precisely weighed, and shaken in an Erlenmeyer flask with a stopper together with 70% sulfuric acid at 25° C. in an amount that was 100 times the sample weight for at least 10 minutes to dissolve the cellulosic fiber (containing the phosphorus compound). The resultant mixture was filtered by suction filtration. After that, the residue on a funnel was washed successively with 70% sulfuric acid at 25° C. in an amount that was 100 times the sample weight and with water at 25° C. in an amount that was 100 times the sample weight. Then, the residue after washing was neutralized with a dilute aqueous ammonia solution (about 1%) in an amount that was about 50 times the sample weight. Again, the resultant mixture was filtered by suction filtration, and after that the residue on a funnel was washed with water and dried. The weight of the residue after drying was measured, and the cellulosic fiber content was measured using an equation below.

Cellulosic fiber content in flame-retardant fabric (wt %)=[(sample weight−weight of residue after drying)/sample weight]×100

Antimony Content

The antimony content in each flame-retardant fabric was measured through fluorescent X-ray analysis using a fluorescent X-ray device ("SEA2210A" manufactured by SII NanoTechnology Inc.). The fluorescent X-ray intensity of antimony was measured using a standard sample having a known antimony content, and a calibration curve was created in advance. Then, the fluorescent X-ray intensity of antimony in a sample (flame-retardant fabric) was measured, and the antimony content in the sample (flame-retardant fabric) was calculated by checking the measured fluorescent X-ray intensity against the calibration curve.

Phosphorus Content

The phosphorus content in each flame-retardant fabric was measured through fluorescent X-ray analysis using a fluorescent X-ray device ("SEA2210A" manufactured by SII NanoTechnology Inc.). The fluorescent X-ray intensity of phosphorus was measured using a standard sample having a known phosphorous content, and a calibration curve was created in advance. Then, the fluorescent X-ray intensity of phosphorus in a sample (flame-retardant fabric) was measured, and the phosphorus content in the sample (flame-retardant fabric) was calculated by checking the measured fluorescent X-ray intensity against the calibration curve.

Flame Resistance

The length of a charred portion (char length) of each flame-retardant fabric was obtained in conformity with a flame resistance test based on ASTM (American Society for Testing and Materials) D6413-08. Also, the after flame time and the afterglow time of the flame-retardant fabric after being brought into contact with flame were obtained in second in conformity with a flame resistance test based on ASTM (American Society for Testing and Materials) D6413-08.

Tear Strength

The tear strength of each flame-retardant fabric was measured in conformity with a tear strength test based on the ASTM D1424 pendulum method.

Texture

With regard to the texture of each flame-retardant fabric, a sensory evaluation was performed based on a three-grade scale below.

A: The fabric is soft and unlikely to crease.

B: The fabric is slightly soft, slightly stiff, and likely to crease.

C: The fabric is hard, stiff, and likely to crease.

TABLE 3

| | Content in flame-retardant fabric (wt %) | | | | Weight per | | | | | |
|---|---|---|---|---|---|---|---|---|---|---|
| | Modacrylic fiber | Cellulosic fiber | Sb | Phosphorus | unit area ($g/m^2$) | Char length (inch) | Afterflame (sec.) | Afterglow (sec.) | Tear strength (kgf) | Texture |
| Ex. 1 | 51.3 | 48.7 | 9.3 | 0.73 | 180 | 3.98 | 0 | 0 | 1.6 | A |
| Ex. 2 | 42.8 | 57.2 | 7.6 | 0.51 | 280 | 3.6 | 0 | 0 | 2.2 | B |
| Ex. 3 | 51.7 | 48.3 | 3.9 | 0.63 | 181 | 3.96 | 0 | 0 | 1.7 | A |
| Ex. 4 | 28.8 | 71.2 | 5.1 | 0.4 | 250 | 3.6 | 0 | 0 | 2.2 | A |
| Ex. 5 | 43.3 | 56.7 | 5.1 | 0.4 | 300 | 3.6 | 0 | 0 | 2.3 | C |
| Ex. 6 | 26.9 | 73.1 | 5.6 | 0.9 | 223 | 3.47 | 0 | 0 | 2.6 | A |
| Ex. 7 | 27.1 | 72.9 | 5.7 | 1.3 | 221 | 3.43 | 0 | 0 | 2.0 | A |
| Ex. 8 | 27.0 | 73.0 | 5.7 | 1.4 | 222 | 3.62 | 0 | 0 | 1.8 | A |
| Ex. 9 | 27.4 | 72.6 | 5.8 | 1.1 | 208 | 3.8 | 0 | 0 | 1.9 | A |
| Com. Ex. 1 | 0 | 100 | 0.0 | 1.2 | 186 | 4.5 | 0 | 0 | 1.3 | A |
| Com. Ex. 2 | 9.1 | 90.9 | 1.8 | 0.95 | 195 | 4.45 | 0 | 0 | 1.5 | A |
| Com. Ex. 3 | 75.8 | 24.2 | 5.8 | 0.55 | 235 | 4.6 | 0 | 0 | 1.9 | A |
| Com. Ex. 4 | 75.5 | 24.5 | 13.4 | 0.6 | 155 | 4.24 | 0 | 0 | 1.4 | A |
| Com. Ex. 5 | 18.3 | 81.7 | 0.6 | 0.92 | 221 | 4.5 | 0 | 0 | 1.6 | A |
| Com. Ex. 6 | 44.7 | 55.3 | 7.9 | 0.06 | 289 | 4.1 | 0 | 0 | 2.2 | C |
| Com. Ex. 7 | 27.9 | 72.1 | 5.9 | 0.26 | 215 | 4.42 | 0 | 0 | 3.2 | A |
| Com. Ex. 8 | 27.1 | 72.9 | 4.8 | 1.07 | 155 | 3.21 | 0 | 0 | 1.3 | A |
| Com. Ex. 9 | 55.9 | 44.1 | 9.8 | 0.7 | 167 | 4.16 | 0 | 0 | 1.5 | A |
| Com. Ex. 10 | 14.7 | 85.3 | 2.6 | 0.2 | 194 | 4.91 | 0 | 0 | 1.9 | A |
| Com. Ex. 11 | 27.4 | 72.6 | 5.8 | 2.1 | 208 | 4.57 | 0 | 0 | 0.9 | C |
| Com. Ex. 12 | 30 | 70 | 6.3 | 3.2 | 240 | 4.5 | 0 | 0 | 1.6 | A |

TABLE 4

| | Content in flame-retardant fabric (wt %) | | | | Weight per | | | |
|---|---|---|---|---|---|---|---|---|
| | Modacrylic fiber | Cellulosic fiber | Sb | Phosphorus | unit area ($g/m^2$) | Char length (inch) | Afterflame (sec.) | Afterglow (sec.) |
| Ex. 10 | 50 | 50 | 1.8 | 0.8 | 189 | 3.82 | 0 | 0 |
| Ex. 11 | 36.4 | 63.6 | 1.9 | 0.8 | 196 | 3.78 | 0 | 0 |
| Ex. 12 | 50 | 50 | 2.6 | 0.8 | 192 | 3.27 | 0 | 0 |
| Ex. 13 | 27.3 | 72.7 | 4.8 | 0.8 | 190 | 3.07 | 0 | 0 |
| Ex. 14 | 27.3 | 72.7 | 2.1 | 1.0 | 196 | 2.8 | 0 | 0 |
| Ex. 15 | 27.3 | 72.7 | 2.1 | 0.4 | 190 | 3.74 | 0 | 0 |

TABLE 4-continued

| | Content in flame-retardant fabric (wt %) | | | | Weight per | | | |
|---|---|---|---|---|---|---|---|---|
| | Modacrylic fiber | Cellulosic fiber | Sb | Phosphorus | unit area ($g/m^2$) | Char length (inch) | Afterflame (sec.) | Afterglow (sec.) |
| Ex. 16 | 18.2 | 81.8 | 3.2 | 0.4 | 190 | 3.94 | 0 | 0 |
| Ex. 17 | 18.2 | 81.8 | 3.2 | 1.0 | 197 | 3.35 | 0 | 0 |
| Com. Ex. 13 | 27.3 | 72.7 | 2.1 | 0.2 | 190 | 4.17 | 0 | 0 |
| Com. Ex. 14 | 36.4 | 63.6 | 1.2 | 0.8 | 186 | 4.57 | 0 | 0 |

As can be seen from the results in Table 3 above, the flame-retardant fabrics of Examples 1 to 9, which each included the natural cellulose fiber containing the phosphorus compound and the modacrylic fiber containing the antimony compound, included the modacrylic fiber containing the antimony compound in an amount of 14 to 54 wt %, antimony in an amount of not less than 1.7 wt %, and phosphorus in an amount of 0.3 to 1.5 wt % with respect to the total weight of the flame-retardant fabric, and had a weight per unit area of not less than 160 $g/m^2$, had a char length of not more than 4 inches and a tear strength of not less than 1.5 kgf and had excellent flame resistance and durability. As can be seen from the results in Table 4 above, the flame-retardant fabrics of Examples 10 to 17 also had a char length of not more than 4 inches and had excellent flame resistance. Moreover, the flame-retardant fabrics having a weight per unit area of less than 300 $g/m^2$ had improved texture, and the flame-retardant fabrics having a weight per unit area of not more than 280 $g/m^2$ had favorable texture.

On the other hand, the flame-retardant fabrics of Comparative Examples 6, 7, 10, and 13, which contained phosphorus in an amount of less than 0.3 wt %, had a char length of more than 4 inches and had poor flame resistance. The flame-retardant fabric of Comparative Example 11, which contained phosphorus in an amount of more than 1.5 wt %, had a tear strength of not more than 1.4 kgf and had poor durability. Moreover, since the flame-retardant fabric of Comparative Example 11 had an excessively low tear strength due to an excessively high phosphorus content, this flame-retardant fabric also had a char length of more than 4 inches and had poor flame resistance. The flame-retardant fabrics of Comparative Examples 5 and 14, which contained antimony in an amount of less than 1.7 wt %, had a char length of more than 4 inches and had poor flame resistance. The flame-retardant fabrics of Comparative Examples 3 and 9, which contained the antimony compound-containing modacrylic fiber in an amount of more than 54 wt %, had a char length of more than 4 inches and had poor flame resistance. The flame-retardant fabric of Comparative Example 2, which contained the antimony compound-containing modacrylic fiber in an amount of less than 14 wt %, also had a char length of more than 4 inches and had poor flame resistance. The flame-retardant fabric of Comparative Example 8, which had a weight per unit area of less than 160 $g/m^2$, had a tear strength of not more than 1.4 kgf and had poor durability. The flame-retardant fabric of Comparative Example 4, which contained the antimony compound-containing modacrylic fiber in an amount of more than 54 wt % and had a weight per unit area of less than 160 $g/m^2$, had a char length of more than 4 inches and a tear strength of not more than 1.4 kgf, and both the flame resistance and the durability were poor. The flame-retardant fabric of Comparative Example 1, which included no modacrylic fiber, had a char length of more than 4 inches and a tear strength of not more than 1.4 kgf, and both the flame resistance and the durability were poor. The flame-retardant fabric of Comparative Example 12, which included no natural cellulose fiber but included FR rayon, had a char length of more than 4 inches, and had poor flame resistance.

FIG. 1 is a graph illustrating the modacrylic fiber content, the phosphorous content, and the char length with respect to the flame-retardant fabrics of the examples and the comparative examples. In FIG. 1, I corresponds to Comparative Example 1, II corresponds to Comparative Example 2, III corresponds to Comparative Example 10, IV corresponds to Example 16, V corresponds to Comparative Example 5, VI corresponds to Example 6, VII corresponds to Example 8, VIII corresponds to Comparative Example 8, IX corresponds to Example 4, X corresponds to Example 2, XI corresponds to Example 5, XII corresponds to Comparative Example 6, XIII corresponds to Example 1, XIV corresponds to Example 3, XV corresponds to Comparative Example 9, XVI corresponds to Comparative Example 4, and XVII corresponds to Comparative Example 12. Also, in FIG. 1, bubbles (circles) represent the char length; smaller circle sizes mean shorter char lengths. Specifically, the bubble (circle) size is proportional to the value obtained by subtracting 3 from the value of the char length. In FIG. 1, ● (solid circles) correspond to char lengths of not more than 4 inches. As can be seen from FIG. 1, those flame-retardant fabrics having an excessively low modacrylic fiber content had a char length of more than 4 inches and had poor flame resistance. Moreover, surprisingly, those flame-retardant fabrics having an excessively high modacrylic fiber content also had a char length of more than 4 inches and had poor flame resistance. Specifically, among the flame-retardant fabrics having a phosphorus content of 0.3 to 1.5 wt % and an antimony content of not less than 1.7 wt %, only those flame-retardant fabrics having a modacrylic fiber content within a range of 14 to 54 wt % had a char length of not more than 4 inches and had high flame resistance.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A flame-retardant fabric comprising:

a cellulosic fiber; and a modacrylic fiber, wherein the cellulosic fiber is a natural cellulose fiber comprising a phosphorus compound, and the phosphorus compound is bound to a cellulose molecule or forms an insoluble polymer in the fiber, the modacrylic fiber comprises an antimony compound, the flame-retardant fabric comprises the antimony-containing modacrylic fiber in an amount of 14 to 54 wt %, antimony in an amount of not less than 1.7 wt %, and phosphorus in an amount of 0.3 to 1.5 wt % with respect to a total weight of the flame-retardant fabric, and the flame-retardant fabric has a weight per unit area of 180 to 250 g/m$^2$, and has an afterflame time and an afterglow time of 0 seconds with a flame resistance test based on ASTM D6413.08.

2. The flame-retardant fabric according to claim 1, wherein the flame-retardant fabric has a tear strength of not less than 1.5 kgf, the tear strength being measured through a tear strength test based on ASTM D1424 pendulum method.

3. The flame-retardant fabric according to claim 1, wherein the flame-retardant fabric comprises the antimony-containing modacrylic fiber in an amount of 18 to 45 wt % with respect to the total weight of the flame-retardant fabric.

4. The flame-retardant fabric according to claim 3, wherein the flame-retardant fabric comprises the antimony-containing modacrylic fiber in an amount of 22 to 35 wt % with respect to the total weight of the flame-retardant fabric.

5. The flame-retardant fabric according to claim 1, wherein the antimony-containing modacrylic fiber comprises the antimony compound in an amount of 1.6 to 33 wt % with respect to a total weight of the fiber.

6. The flame-retardant fabric according to claim 1, wherein the antimony compound is one or more compounds selected from the group consisting of antimony trioxide, antimony tetraoxide, and antimony pentoxide.

7. The flame-retardant fabric according to claim 1, wherein the flame-retardant fabric has a char length of not more than 4 inches, the char length being measured through a flame retardancy test based on ASTM D6413-08.

8. The flame-retardant fabric according to claim 1, wherein the flame-retardant fabric comprises phosphorus in an amount of 0.3 to 1.1 wt % with respect to the total weight of the flame-retardant fabric.

9. A method for producing a flame-retardant fabric comprising: a cellulosic fiber; and a modacrylic fiber, wherein the cellulosic fiber is a natural cellulose fiber comprising a phosphorus compound, the modacrylic fiber comprises an antimony compound, the flame-retardant fabric comprises the antimony-containing modacrylic fiber in an amount of 14 to 54 wt %, antimony in an amount of not less than 1.7 wt %, and phosphorus in an amount of 0.3 to 1.5 wt % with respect to a total weight of the flame-retardant fabric, and the flame-retardant fabric has a weight per unit area of 180 to 250 g/m$^2$, and the method comprising:

subjecting a fabric comprising a natural cellulose fiber and a modacrylic fiber comprising an antimony compound to flame-retardant treatment with a phosphorus compound, wherein the flame-retardant treatment is performed by Pyrovatex treatment or ammonia curing using a tetrakis hydroxyalkyl phosphonium salt, wherein the flame retardant fabric has an afterflame time and an afterglow time of 0 seconds with a flame resistance test based on ASTM D6413.08.

10. The method for producing a flame-retardant fabric according to claim 9, wherein the phosphorus compound is an N-methylol phosphonate compound or a tetrakis hydroxyalkyl phosphonium salt.

11. Fire-protective clothing comprising the flame-retardant fabric according to claim 1.

12. The Fire-protective clothing according to claim 11, wherein the flame-retardant fabric has a tear strength of not less than 1.5 kgf, the tear strength being measured through a tear strength test based on ASTM D1424 pendulum method.

13. The Fire-protective clothing according to claim 11, wherein the flame-retardant fabric comprises the antimony-containing modacrylic fiber in an amount of 18 to 45 wt % with respect to the total weight of the flame-retardant fabric.

14. The Fire-protective clothing according to claim 11, wherein the natural cellulose fiber containing the phosphorus compound, the phosphorus compound is bound to a cellulose molecule or forms an insoluble polymer in the fiber.

15. The Fire-protective clothing according to claim 11, wherein the flame-retardant fabric has a char length of not more than 4 inches, the char length being measured through a flame retardancy test based on ASTM D6413-08.

16. The Fire-protective clothing according to claim 11, wherein the flame-retardant fabric comprises phosphorus in an amount of 0.3 to 1.1 wt % with respect to the total weight of the flame-retardant fabric.

* * * * *